United States Patent [19]

Stephenson

[11] 4,194,485

[45] Mar. 25, 1980

[54] THROTTLING PASSAGEWAY TO DECREASE COAST-DOWN TIME OF LAWN MOWER ENGINES

[75] Inventor: Donald K. Stephenson, Sussex, Wis.

[73] Assignee: Outboard Marine Corporation, Waukegan, Ill.

[21] Appl. No.: 928,554

[22] Filed: Jul. 27, 1978

[51] Int. Cl.[2] ..... F02B 77/08

[52] U.S. Cl. ..... 123/198 DC; 123/182; 56/10.5

[58] Field of Search ..... 123/198 D, 198 DC, 198 F, 123/182; 56/10.5, DIG. 15

[56] References Cited

U.S. PATENT DOCUMENTS

| | | | |
|---|---|---|---|
| 2,778,349 | 1/1957 | Thommen | 123/182 |
| 2,943,615 | 7/1960 | Kainz | 123/198 DC |
| 3,400,702 | 9/1968 | Watkins | 123/198 F |
| 3,849,620 | 11/1974 | Melidz | 123/198 DC |
| 3,955,653 | 5/1976 | Comer | 56/10.5 |
| 4,079,721 | 3/1978 | Brown | 123/198 DC |

*Primary Examiner*—Ira S. Lazarus

*Attorney, Agent, or Firm*—Michael, Best & Friedrich

[57] ABSTRACT

Disclosed herein is a lawn mower including a rotatable cutter blade, a reciprocating internal combustion engine drivingly connected to the cutter blade and a venting arrangement for venting the engine cylinder combustion chamber at engine shut down to decrease the engine coast-down time. The venting arrangement includes a flow passage having an inlet port which opens into the combustion chamber and a discharge port which either opens directly to the atmosphere, is connected in communication with the engine crankcase, or is connected in communication with the engine exhaust system. Venting of the combustion chamber through the flow passage is selectively controlled by a valve which is operably connected to the ignition switch and is opened in response to movement of the ignition switch from an engine operating position to an engine shutoff position. The valve remains open during engine coast down and the minimum cross sectional flow area of the flow passage is sized relative to the volumetric displacement of the piston so as to produce pumping losses which minimize the time required for the engine to come to a complete stop.

7 Claims, 5 Drawing Figures

THROTTLING PASSAGEWAY TO DECREASE COAST-DOWN TIME OF LAWN MOWER ENGINES

BACKGROUND OF THE INVENTION

The invention relates to lawn mowers and, more particularly, to lawn mowers operated by an internal combustion engine and including means for reducing engine coast-down time.

In order to reduce the time during which the cutter blade of the lawn mower continues to rotate after the engine ignition has been shut off, it is desirable to reduce the time required for the engine to coast down or come to a complete stop.

Various valving arrangements have been used for braking internal combustion engines. Attention is directed to the following United States patents and patent application:

| PATENTEE | U.S. PAT. NO. | ISSUE DATE |
|---|---|---|
| Menesson | 2,440,483 | April 27, 1948 |
| Thommen | 2,778,349 | January 22, 1957 |
| Haller | 2,968,295 | January 17, 1961 |
| Haller | 3,326,194 | June 20, 1967 |
| Boling | 3,638,632 | February 1, 1972 |
| Bygdnes | 3,667,435 | June 6, 1972 |
| Knebel | 3,707,952 | January 2, 1973 |
| Comer | 3,955,653 | May 11, 1973 |
| Holtermann | S.N. 705,140 | filed January 14, 1976 |

SUMMARY OF THE INVENTION

The invention provides a lawn mower including a frame, a rotatable cutter blade supported on the frame, an internal combustion engine including an engine block having a cylinder, a piston mounted inside the cylinder for reciprocative movement between top dead center and bottom dead center positions and cooperating with the cylinder to form a combustion chamber, and an exhaust port in the engine block for exhausting gases from the combustion chamber during movement of the piston, an electrical ignition circuit for supplying ignition current to a spark plug, a switch in the ignition circuit and movable between an engine operating position and an engine shutoff position to interrupt flow of ignition current to the spark plug, and means for reducing the coast-down time of the engine including a flow passage having a discharge port and an inlet port opening into the combustion chamber and a valve disposed in the flow passage for movement between a closed position to prevent flow through the flow passage and an open position to permit flow through the flow passage.

The valve is operably connected to the ignition switch, is moved to the open position in response to movement of the ignition switch from an engine operating position to an engine shutoff position, and is moved to the closed position in response to movement of the ignition switch from the engine shutoff position to the engine operating position. After the engine has been shut off, a portion of the gases in the combustion chamber is forced out through the flow passage during the compression stroke of the piston and a lesser amount of gases are "sucked" back through the flow passage into the combustion chamber during the expansion stroke of the piston. This increases pumping losses which cause the engine to rapidly come to a complete stop.

The flow passage is sized relative to the volumetric displacement of the piston so as to minimize the overall coast-down time of the engine. That is, the ratio of the volume swept by the piston (cubic inches), during movement from the exhaust port closure to top dead center, to the minimum cross sectional flow area of the flow passage is 320 to 480 inches and/or the ratio of the volume swept by the piston (cubic inches), during movement from the bottom dead center to the top dead center, to the minimum cross sectional flow area of the flow passage is 440 to 660 inches.

In one embodiment, the discharge outlet of the flow passage is connected in communication with the engine crankcase.

In another embodiment, the discharge outlet of the flow passage opens directly to the atmosphere.

In a further embodiment of the invention, the discharge outlet of the flow passage is connected in communication with the exhaust system.

One of the principal features of the invention is the provision of a lawn mower including an internal combustion engine for driving a cutter blade and means for reducing the engine coast-down time after termination of ignition.

Another of the principal features of the invention is the provision of a lawn mower referred to in the previous paragraph including a simplified arrangement for venting the engine cylinder combustion chamber in response to movement of an engine ignition switch to an engine shutdown position.

A further of the principal features of the invention is the provision of a lawn mower referred to in the previous paragraph including a flow passage which is connected in communication with the combustion chamber and has a minimum cross sectional flow area sized in accordance with a critical ratio relative to the volumetric displacement of the piston and a valve which is operably connected to the engine ignition switch and is moved to the open position in response to movement of the ignition switch to the shutoff position to permit gases to be pumped back and forth through the flow passage during subsequent piston reciprocation.

Other features and advantages of the embodiments of the invention will become apparent upon reviewing the following detailed description, the drawing and the appended claims.

Figure 2:
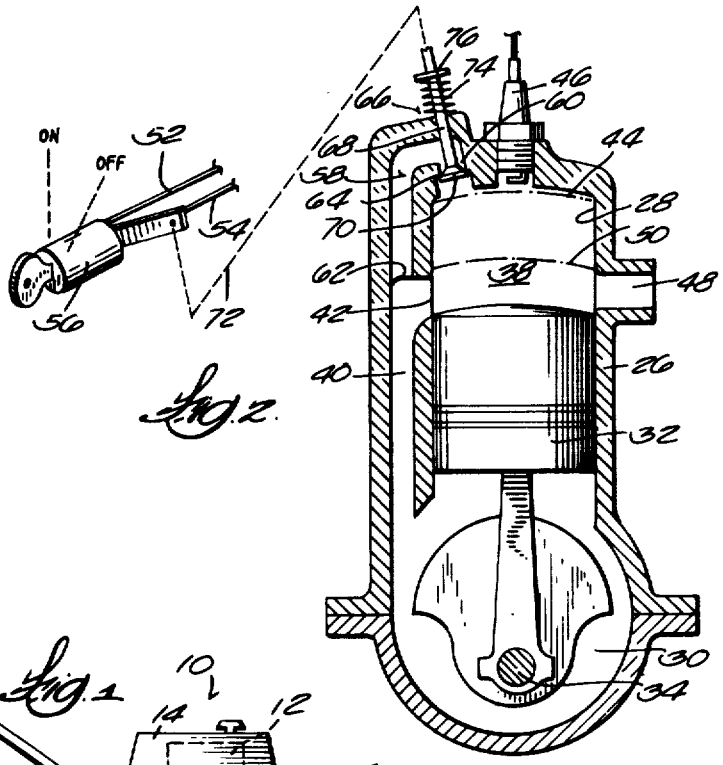
FIG. 2 is an enlarged, fragmentary view, partially in section and partially schematic, of the engine in the lawn mower shown in FIG. 1.

Before explaining at least one embodiment of the invention in detail, it is to be understood that the invention is not limited in its application to the details of construction and the arrangements of the components set forth in the following description or illustrated in the drawing. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EMBODIMENTS

Figure 1:
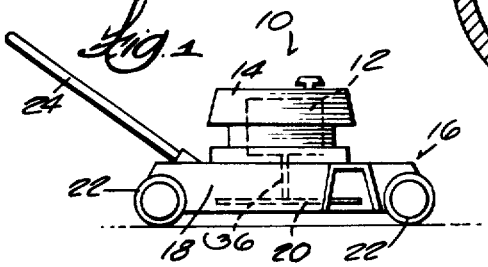
FIG. 1 is a side elevational view of a lawn mower embodying various of the features of the invention.

Illustrated in the drawing (FIG. 1) is a lawn mower 10 including an internal combustion engine 12, preferably a conventional 2-cycle engine, partially covered by a shroud 14 and supported on a frame 16 including a blade housing 18. The lawn mower 10 also includes a rotary cutter blade 20 located inside the blade housing 18 and is supported for travel along the ground by front and rear wheels 22. The lawn mower 10 is guided by a handle 24 suitably mounted on and extending rearwardly from the frame 16.

The engine 12 (FIG. 2) has an engine block 26 including one or more cylinders 28 extending from a crankcase 30. Disposed in each cylinder 28 is a reciprocative piston 32 drivingly connected to the cutter blade 20 by a crankshaft 34 which extends through the crankcase 30 and is drivingly connected to a drive shaft 36 carrying the cutter blade 20. The piston 32 cooperates with the cylinder 28 to form a combustion chamber 38. A combustible charge comprising a mixture of air and gasoline is introduced into the combustion chamber 38 through an intake or transfer passage 40 located on one side of the cylinder and connected in communication with the crankcase 30 in a conventional manner. More specifically, the combustion charge flows from the transfer passage 40 into the combustion chamber 38 through one or more intake ports 42 and is compressed in the combustion chamber 38 during the upstroke or compression stroke of the piston 32, i.e., during movement of the piston 32 from the bottom dead center position illustrated in solid lines to the top dead center position illustrated by dashed line 44.

The compressed charge is ignited by a spark plug 46 located in the head or top of the cylinder 28 and the subsequent combustion increases the pressure of the confined gases. These gases expand during the down stroke or expansion stroke of the piston 32, i.e., during movement of the piston 32 from the top dead center position to the bottom dead center position, and the combustion products are exhausted to the atmosphere near the end of the expansion stroke through an exhaust passage or port 48, located on the side of the cylinder 28 opposite to the intake passage 40, and a muffler (not shown). The pressure inside the crankcase 30 decreases in response to movement of the piston 32 through the compression stroke and increases in response to movement of the piston 32 through the expansion stroke.

Figure 5:
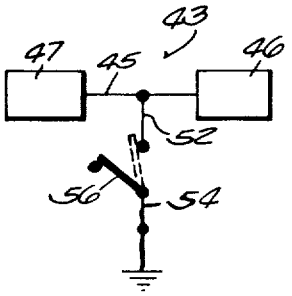
FIG. 5 is a diagrammatic representation of the engine electrical circuitry.

The engine 12 also includes an electrical ignition circuit 43 (illustrated diagrammatically in FIG. 5) including an electrical lead 45 connecting an electrical power supply 47, such as a flywheel magneto, to the spark plug 46 and an on-off ignition switch 56 connected between the supply lead 45 and the engine ground via electrical leads 52 and 54. The ignition switch 56 is movable between an "on" or engine operating position (illustrated by the solid line in FIG. 5) to permit flow of ignition current to the spark plug 46 and an "off" or engine shutoff position (illustrated by the dashed line in FIG. 5) to ground the power supply 47 and thereby interrupt flow of ignition current to the spark plug 46.

When the engine ignition is shut off, the piston 32 normally continues to reciprocate for some time, e.g., four seconds or more, with a consequent continued rotation of the cutter blade 20. The coast-down or stopping time of the engine, and thus the cutter blade, is reduced by providing a combustion chamber venting arrangement including a flow passage and a valve which is opened in response to movement of the ignition switch 56 to the engine shutoff position to permit limited venting of the combustion chamber 38 through the flow passage during the compression stroke of the piston 32 and remains open so that gases are pumped back into the combustion chamber 38 through the flow passage during the expansion stroke of the piston 32.

In the specific construction illustrated in FIG. 2, the combustion chamber venting arrangement includes a flow passage 58 in the engine block 26 having an inlet port 60 opening into the combustion chamber 38, preferably in a location near the top end of the cylinder 28 not swept by the piston 32, and a discharge port 62 opening into the transfer passage 40, and thus into the crankcase 30. The portion of the engine block 26 surrounding the inlet port 60 is adapted to serve as a valve seat 64 as described hereinafter.

Disposed in the flow passage 58 for selectively venting the combustion chamber 38 into the crankcase 30 is a valve 66 including a slidably mounted stem 68 which extends exteriorly of the engine block 26 and a valve member 70 which sealingly engages the valve seat 64 when in the closed position illustrated. The ignition switch 56 is operably connected to the valve 66 by a mechanical linkage (illustrated schematically by dashed line 72) which is arranged in a suitable manner to effect movement of the valve 66 from the closed position to an open position (i.e., to move the valve member 70 downwardly away from the seat 64) in response to movement of the ignition switch 56 from the engine operating position to the engine shutoff position. The valve 66 remains in the open position as long as the ignition switch 56 is in the engine shutoff position and is returned to the closed position in response to the movement of the ignition switch 56 from the engine shutoff position to the engine operating position.

Means preferably are provided for urging the valve member 70 toward the closed position. In the specific construction illustrated, such means includes a coiled compression spring 74 encircling the outer end of the valve stem 68 and bearing against a retainer or collar 76 carried on the valve stem 68. Alternately, the linkage arrangement 72 can be provided with a spring (not shown) which imposes a closing bias on the valve 66 through the linkage.

In operation, the engine 12 can be started and/or operated in a normal manner when the ignition switch 56 is in the "on" or engine operating position. When the ignition switch 56 is moved to the "off" or engine shutoff position, ignition current to the spark plug 46 is interrupted and the valve 66 is moved to the open position. During the subsequent compression stroke of the piston 32, a portion of the compressed gases in the combustion chamber 38 is forced out through the flow passage 58 into the crankcase 30, at which time a reduced pressure exists in the crankcase 30, resulting in a reduction in the pressure available in the combustion chamber 38 to act on the piston 32 during its return stroke.

During the initial portion of the return stroke, compressed gases continue to flow out through the flow passage 58 until the expanding volume of the combustion chamber 38 drops the combustion chamber pressure to atmospheric. Additional motion of the piston 32 during the return stroke tends to create a partial vacuum in the combustion chamber 38 and the limited amount of gases which can flow back through the flow passage 58 and into the combustion chamber only partially reduces the vacuum created. The vacuum increases with the continued motion of the piston 32 until exhaust port 48 is uncovered and the combustion chamber 38 is opened to the exhaust system.

To effectively reduce engine speed, one objective is to maintain pressure in the combustion chamber 38 during the compression stroke so that the net gas pressure force acting upon the piston 32 produces a torque acting on the crankshaft 34 in a direction opposite to the direction of crankshaft rotation, thereby tending to reduce engine speed. Another objective is to create a partial vacuum in the combustion chamber 38 during the return stroke so that the net gas pressure force acting on the piston 32 produces a torque acting on the crankshaft 34 in a direction opposite to the direction of crankshaft rotation. If the minimum cross sectional flow area of the flow passage 58 is small, high pressures will be maintained in the combustion chamber 38 during the compression stroke and little or no partial vacuum will be created during the return stroke. On the other hand, if the minimum cross sectional flow area of the flow passage 58 is larger, lower pressures will be maintained in the combustion chamber 38 during the compression stroke and substantial partial vacuum will be created during part of the return stroke.

It has been found that the overall time required for the engine to come to a complete stop can be reduced to a minimum by sizing the flow passage 58 so that the ratio of the volume swept by the piston 32 (cubic inches) between the time the exhaust port 38 is closed and the top dead center position (actual displacement), i.e., volume swept by the piston 32 as it moves from the dashed line position 50 to the dashed line position 44, to the minimum cross sectional flow area of the flow passage 58 (square inches) is about 320 to about 480 inches, most preferably about 400 inches and/or when the ratio of the volume swept by the piston (cubic inches) during movement from bottom dead center to top dead center (nominal displacement) to the minimum cross sectional flow area of the flow passage 58 (square inches) is about 440 to about 660 inches, most preferably about 550 inches. When the above ratios are within these ranges, the pressure ratio between the inlet port 60 and the discharge port 62 is above the critical pressure ratio for a nozzle. Thus, flow through the flow passage 58 is at a sonic velocity during at least a major portion of the time for engine coast down and the length of the flow passage 58 is not particularly important. For instance, the length of the flow passage 58 can be varied from as small as about ½ inch up to as much as 12 inches or more without significantly changing the time for the engine to come to a complete stop.

Figure 3:
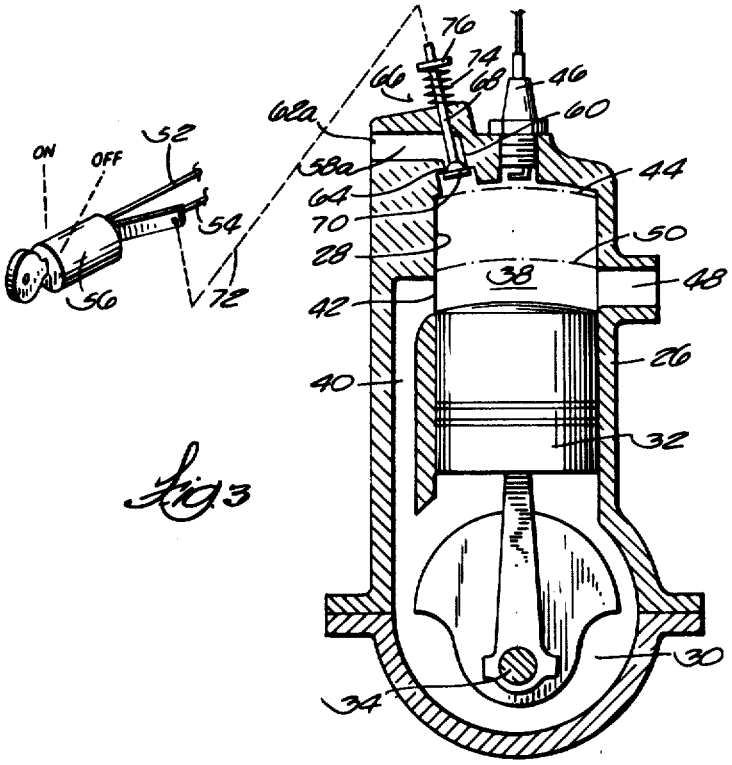
FIG. 3 is a view similar to FIG. 2 showing an alternate arrangement for the combustion chamber venting system.

In the embodiment illustrated in FIG. 3, the flow passage 58*a* is arranged so that the discharge port 62*a* opens directly to the atmosphere. The lawn mower otherwise is arranged and operated in the same manner as described above in connection with the embodiment illustrated in FIG. 2.

Figure 4:
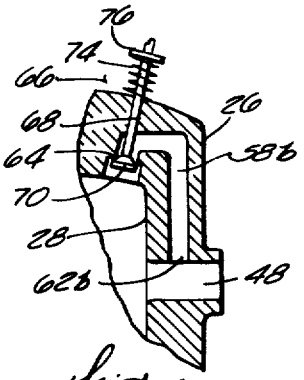
FIG. 4 is a fragmentary view of the engine illustrating another alternate arrangement for the combustion chamber venting system.

In the alternate embodiment illustrated in FIG. 4, the flow passage 58*b* extends through the engine block 26 on the side of the cylinder 28 opposite to the transfer passage 40 and the discharge port 62*b* opens into the exhaust port 48. If desired, the flow passage 58*b* can be formed at least in part, by a separate conduit which is connected directly to the exhaust muffler. Thus, the term "exhaust port" as used herein in connection with the flow passage includes the exhaust port in the cylinder, the exhaust manifold, and the exhaust muffler, i.e., the exhaust system.

While a specific valve arrangement has been described and illustrated in detail, various other suitable valve arrangements operable in response to movement of the ignition switch can be used, e.g., a rotary type valve disposed in the flow passage between the inlet and discharge ports and operably connected to the ignition switch by a push-pull cable or the like.

Various of the features of the invention are set forth in the following claims:

What is claimed is:

1. A lawn mower comprising a frame, a rotatable cutter blade supported on said frame, an internal combustion engine supported on said frame and including an engine block having a cylinder, a piston mounted inside said cylinder for reciprocative movement between top dead center and bottom dead center positions and cooperating with said cylinder to form a combustion chamber, and an exhaust port in said engine block for exhausting gases from said combustion chamber, said piston closing said exhaust port during movement from the bottom dead center position toward the top dead center position, a spark plug mounted on said engine block and having electrodes communicating with said combustion chamber, an electrical ignition circuit for supplying ignition current to said spark plug, a switch connected in said ignition circuit and movable between an engine operating position to permit flow of ignition current to said spark plug and an engine shutoff position to interrupt flow of ignition current to said spark plug, and means for reducing the coast-down time of said engine including means defining a flow passage having a discharge port and an inlet port opening into said combustion chamber, the ratio of the volume swept by said piston (cubic inches), during movement from closure of said exhaust port to the top dead center position, to the minimum cross sectional flow area of said flow passage (square inches) being about 320 to about 480 inches, a valve disposed in said flow passage for movement between a closed position to prevent flow through said flow passage and an open position to permit flow through said flow passage, and means connecting said switch to said valve for moving said valve to the open position in response to movement of said switch from the engine operating position to the engine shutoff position and for moving said valve to the closed position in response to movement of said switch from the engine shutoff position to the engine operating position.

2. A lawn mower according to claim 1 wherein said discharge port is connected in communication with said exhaust port.

3. A lawn mower according to claim 1 wherein said engine includes a crankcase and wherein said discharge port is connected in communication with said crankcase.

4. A lawn mower according to claim 1 wherein said discharge port communicates directly with the atmosphere.

5. A lawn mower according to claim 1 wherein said ratio is about 400 inches.

6. A lawn mower comprising a frame, a rotatable cutter blade supported on said frame, an internal combustion engine supported on said frame and including an engine block having a cylinder, a piston mounted inside said cylinder for reciprocative movement between top dead center and bottom dead center positions and cooperating with said cylinder to form a combustion chamber, a spark plug mounted on said engine block and having electrodes communicating with said combustion chamber, an electrical ignition circuit for supplying ignition current to said spark plug, a switch connected in said ignition circuit and movable between an engine operating position to permit flow of ignition current to said spark plug and an engine shutoff position to interrupt flow of ignition current to said spark plug, and means for reducing the coast-down time of said engine including means defining a flow passage having a discharge port and an inlet port opening into said combustion chamber, the ratio of the volume swept by said piston (cubic inches), during movement from the bottom dead center position to the top dead center position, to the minimum cross sectional flow area of said flow passage (square inches) being about 440 to about 660 inches, a valve disposed in said flow passage for movement between a closed position to prevent flow through said flow passage and an open position to permit flow through said flow passage, and means connecting said switch to said valve for moving said valve to the open position in response to movement of said switch from the engine operating position to the engine shutoff position and for moving said valve to the closed position in response to movement of said switch from the engine shutoff position to the engine operating position.

7. A lawn mover according to claim 6 wherein said ratio is about 550 inches.

* * * * *